United States Patent [19]

Woodward et al.

[11] Patent Number: 5,008,039

[45] Date of Patent: Apr. 16, 1991

[54] LOW FOAMING RUST INHIBITING COMPOSITION

[75] Inventors: Fred E. Woodward, Palm Beach; Alice P. Hudson, Lake Park, both of Fla.

[73] Assignee: Westvaco Corporation, New York, N.Y.

[21] Appl. No.: 545,819

[22] Filed: Jun. 29, 1990

Related U.S. Application Data

[63] Continuation of Ser. No. 169,214, Mar. 15, 1988, Pat. No. 4,956,106.

[51] Int. Cl.[5] ..... C23F 11/10

[52] U.S. Cl. ..... 252/392; 252/396; 252/321

[58] Field of Search ..... 252/321, 396, 392, 391, 252/403, 407

[56] References Cited

U.S. PATENT DOCUMENTS

| | | | |
|---|---|---|---|
| 3,753,968 | 8/1973 | Ward | 260/97.5 |
| 3,931,029 | 1/1976 | Dutton et al. | 252/392 |
| 3,981,682 | 9/1976 | Ward et al. | 252/396 |
| 3,981,780 | 9/1976 | Scherrer et al. | 252/392 |
| 4,196,134 | 4/1980 | Ball et al. | 252/117 |
| 4,344,861 | 8/1982 | Levy | 252/392 |
| 4,406,811 | 9/1983 | Christensen et al. | 252/392 |
| 4,614,600 | 9/1986 | Schilling et al. | 252/392 |
| 4,683,081 | 7/1987 | Kammann, Jr. et al. | 252/392 |
| 4,740,367 | 4/1988 | Force et al. | 514/70 |

*Primary Examiner*—John S. Maples
*Assistant Examiner*—Valerie Fee
*Attorney, Agent, or Firm*—Terry B. McDaniel; Daniel B. Reece, IV; Richard L. Schmalz

[57] ABSTRACT

A low foaming, rust inhibiting composition is disclosed which contains:

A. a rust inhibiting amount of a dicarboxylic acid of the formula:

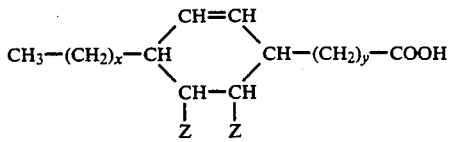

(1)

wherein Z is COOH or H, and one of each is present, and x and y are from 3 to 9, with $x+y=12$;

B. a foam inhibiting amount of a triglyceride acid of the formula:

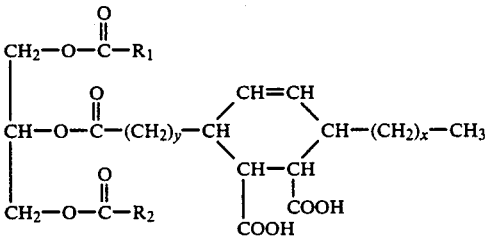

(2)

wherein x and y are integers from 3 to 9, x and y together equal 12. $R_1$ and $R_2$ are saturated/unsaturated hydrocarbon terminals of fatty acids esterified with glycerol; and C. a base sufficient to adjust the pH of the composition of about 6.5 to 10.5.

6 Claims, No Drawings

LOW FOAMING RUST INHIBITING COMPOSITION

This is a continuation of application Ser. No. 07/169,214, filed Mar. 15, 1988 now Pat. No. 4,956,100.

BACKGROUND OF THE INVENTION

1. Field of the Invention

The present invention relates to compositions for inhibiting corrosion of metals which are low foaming in the presence of aqueous media.

2. Description of the Prior Art

Corrosion is a major problem in automotive and industrial systems where major or minor amounts of water come into contact with metals such as iron, steel and ferrous alloys. Such structures as pipelines, storage tanks and internal combustion engines frequently present corrosion problems when in contact with aqueous media, or with non-aqueous media which is subject to condensation of water from the air.

Inhibitors are used to prevent corrosion in such systems. The greatest application of inhibitors is in aqueous cutting and grinding fluids where, because of the high volume of fluid and the high speed of the largely automatic tools, foam is a severe problem. Also in the tapping of aluminum or in high speed grinding or polishing of aluminum, foam, corrosion, and staining are a combined problem.

In order to inhibit corrosion in metals which are exposed to aqueous media, a large range of materials has been employed. Among the systems which have been used are hydrocarbon based systems, which are undesirable from standpoints of cost and safety, and nitrite based systems which present environmental problems. Recently, systems based on long chain fatty acids have been used; such systems are disclosed in U.S. Pat. Nos. 3,981,682, 4,614,600 and 4,683,081.

U.S. Pat. No. 3,981,682 discloses the use of cyclohexene dicarboxylic acids for preventing corrosion in systems containing largely hydrocarbon materials. Amine condensates of such acids are disclosed for rust inhibition in U.S. Pat. Nos. 4,614,600 and 4,683,081.

Inhibition in internal combustion cooling systems with or without the addition of ethylene glycol as an anti-freeze is a major inhibitor problem, and particularly for aluminum. The inhibitors used must not foam excessively. Dicarboxylic acid by itself is particularly effective as an inhibitor, as noted in U.S. Pat. No. 3,931,029, but presents a major foam problem.

While cyclohexene dicarboxylic acids of the type disclosed in U.S. Pat. No. 3,981,682 provide satisfactory corrosion inhibition in systems containing both major and minor amounts of water, these materials present foaming problems as the amount of water in the system increases. Such problems render cyclohexene dicarboxylic acids undesirable in systems with large amounts of water, such as acid solutions used to increase production in oil wells and other operations where ferrous metal surfaces are exposed to strongly acidic environments, such as pickling baths and industrial cleaning.

Other dicarboxylic acids useful in providing rust and corrosion protection in cutting and grinding fluids are the $C_{10}$, $C_{12}$, and $C_{14}$-bis aliphatic dicarboxylic acids. However, they present problems because, in their concentrated form, they are difficult to solubilize in oil and water, and on dilution in tap water they are susceptible to undesirable precipitation, due to hardness.

The partial esters of $C_{21}$-dicarboxylic acids have been used as combined surfactants and rust inhibitors in cutting fluids. However, they hydrolyze at the pH of the fluids, and thus promote foam.

SUMMARY OF THE INVENTION

It is therefore an object of the invention to provide a corrosion inhibiting composition which is low foaming in aqueous media.

It is a further object of the invention to provide a corrosion inhibiting composition whose effectiveness in inhibiting corrosion is not reduced by foam reducing agents.

In order to achieve these and other objects of the invention, a composition is provided containing a major, corrosion inhibiting amount of a $C_{21}$-cyclohexene dicarboxylic acid and a minor amount of a vegetable oil adduct.

DETAILED DESCRIPTION OF THE INVENTION

The dicarboxylic acid corrosion inhibiting materials of the present invention are generally derived from tall oil fatty acids, and more specifically from linoleic acid. Liquid $C_{21}$-cyclohexene dicarboxylic acids having the following structure:

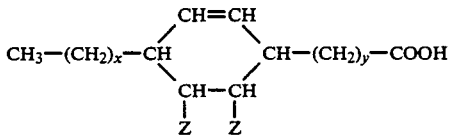

(1)

wherein x and y are integers from 3 to 9, $x+y=2$, and Z is selected from the group consisting of H and COOH, with one Z of each moiety, are useful. These acids are produced by reacting linoleic acid or a mixture of acids containing linoleic acid with acrylic acid in a Diels-Alder reaction. The preparation of this material known as "Westvaco Diacid ®" (1) is set forth in detail in U.S. Pat. No. 3,753,968 to Ward, which is hereby incorporated by reference.

It is not necessary to isolate linoleic acid in order to carry out these reactions. Where a multi acid composition such as tall oil is used as the linoleic acid-containing component of the mixture, the monounsaturated fatty acids present in the tall oil remain essentially unchanged in the reaction except for the isomerization of oleic acid to elaidic acid. By distilling off the remaining fatty acids, the desired products in the mixture are enriched.

The compositions of the invention also contain a minor amount of a foam inhibiting material which is a vegetable oil adduct, specifically triglyceride acids of the general formula:

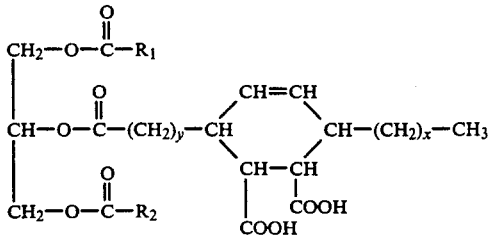

(2)

wherein x and y are integers from 3 to 9, x and y together equal 12. $R_1$ and $R_2$ are fatty acid groups. The adduct is formed by first conjugating the double bonds of the nonconjugated polyunsaturated groups present in the vegetable oil fatty acid ester and elaidinization with a catalyst, such as iodine, and then adduct formation with fumaric acid to form the compounds of the general formula. This adduct formation process is taught, with acrylic acid, in U.S. Pat. No. 4,196,134 and, with fumaric acid, in co-pending commonly assigned U.S. patent application Ser. No. 877,464. The teaching of these references is incorporated herein.

The vegetable oil adducts may be made from vegetable oils having polyunsaturated fatty (mainly, linoleic acid) ester groups in the triglyceride molecule, thereby increasing the carboxyl content of the fatty acid ester groups.

Vegetable oil triglycerides are relatively homogeneous with respect to distribution of linoleic acid in the molecule. Linoleic acid is usually found on the 2-position or middle position of the glyceride with the remainder above 33% on the 1,3 positions. However, in soybean oil only from 17%–27% of the molecules have linoleic on the 1 or 3 positions. Statistically then, at least 50% to 60% of the triglycerides in soybean oil would have a fumaric acid reactive fatty acid group present. The same is true for cottonseed oil and corn oil. Linolenic acid and elaeostearic acid are also reactive, permitting the use of linseed oil. Thus, the vegetable oils useful in the present invention are preferably those having at least 50% polyunsaturated fatty acids in the triglyceride molecule. Examples of other vegetable oils for use in this invention include safflower oil and sunflower oil. Among vegetable oils which are not useful in this invention are palm oil and castor oil having 9.5% and 3.1% linoleic acid, respectively.

It is intended that use of the term "general formula" is to include those adducts having some additions at 1 and 3 positions and also adducts wherein not all reactive sites are formed into adducts. However, when $R_1$ and $R_2$ are not reactive saturated/unsaturated hydrocarbon radicals, they are predominately fatty acid fractions of palmitic acid, stearic acid, and oleic acid.

The relative amounts of dicarboxylic acid and vegetable oil adduct used in the mixtures of the invention will depend upon the amount of water present in the system in which corrosion is to be prevented. In aqueous systems, the vegetable oil adduct has been found to be ineffective as a corrosion inhibitor, although its presence does not decrease the effectiveness of the dicarboxylic acid as a corrosion inhibitor. Accordingly corrosion inhibiting compositions for use in aqueous systems will generally contain about 85 to 95% dicarboxylic acid, and 5 to 15% vegetable oil adduct, and preferably about 90% dicarboxylic acid and 10% vegetable oil adduct.

In systems containing lesser amounts of water and greater amounts of liquid hydrocarbons or other solvents, the vegetable oil adduct does have some effectiveness in itself as a corrosion inhibitor, and therefore greater amounts of this acid are permissible. Generally, systems according to the invention will contain at least about 50% dicarboxylic acid, and no more than about 50% vegetable oil adduct.

The mixture of dicarboxylic acid and vegetable oil adduct of the invention is generally provided at a pH in the range of 6.5 to 10.5, but preferably from 8 to 10.5, and most preferably from 8.3 to 9.5. Adjustment of the pH of the mixture can be accomplished by addition of an alkali metal base such as NaOH, but the preferred pH adjusting compounds are amine compounds. Amines useful as bases for neutralizing the products of this invention include but are not limited to: mono-, di-, and triethanolamine, ethylene diamine, diethylene triamine, aminoethylethanol amine, tripropyl amine, methyldiethanol amine, and 2-amino-2-methyl-1-propanol. Thus, in use, the acids are provided in their salt form.

Utilization of the mixtures of the invention is generally carried out by adding an effective amount of the low foaming rust inhibiting composition to the aqueous medium in storage or passing through the pipes where corrosion is to be prevented. In some cases, it may be desirable to apply the corrosion inhibiting composition directly to the metal surfaces where corrosion is to be prevented.

Rust inhibitor formulations according to the invention are most effective at a pH, at use concentrations, of about 8.3. To achieve this pH, buffering can be done with an alkali metal or ammonium base, but the preferred buffers are triethanolamine (TEA) and diethanolamine (DEA).

To neutralize a caroboxylic acid to a pH of 8.3 with TEA requires a 250% molar excess of TEA over the stoichiometric amount calculated to neutralize the acid. This is because TEA is a weak base with pKB about 6.25. TEA is, however, a strong buffer in the region of 8.3.

Diethanolamine is a stronger base with a $pK_B$ of about 4.9, and requires only about a 16% excess over stoichiometric neutralization amount in order to achieve a pH of 8.3. With DEA, buffering is established at a slightly higher pH than for TEA. Buffering with mixtures of DEA and TEA is also useful.

Various mixtures of dicarboxylic acid blended with tall oil fatty acids and fumarated soybean oil are effective rust inhibitors, and the defoaming properties of the soybean oil adduct are retained.

In a similar manner the invention composition may be mixed with a member of the group consisting of rosin soap, petroleum sulfonates, dodecyl-benzene sulfonic acid and mixtures thereof, and optionally, with mineral oil in proportions of:

1 part the invention dicarboxylic acid-vegetable oil adduct composition;

1 to 20 parts of a member of the above listed group; and 0 to 200 parts of mineral oil;

and, when properly neutralized with a base, results in a clear concentrate which upon dilution with water at a ratio of 1:100 to 1:1 gives emulsions with low or controlled foam and good rust inhibition properties.

EXAMPLE 1

Westvaco Diacid® dicarboxylic acid, vegetable oil adduct, and various mixtures of same were formulated into rust inhibitors with DEA, TEA, or both in the following combinations:

A. DEA to pH 8.3 (16% excess over stoichiometric)

B. DEA to neutralize, then TEA to buffer at 8.3 (an additional 0.63 moles of TEA per mole of acid-DEA salt)

C. TEA in a 16% molar excess over stoichiometric (pH at 7.7).

The combinations were tested by wetting two grams of degreased iron filings with 4 to 5 ml of the diluted inhibitors, pouring off the supernatent and spreading the filings on a 4.25 cm filter paper. After drying overnight, the percent of the bottom surface of the paper stained with rust was estimated. The dicarboxylic acid tends to make spots rather than stains, which is a function of the product, not the test, and in this test results are normally reported as the number of spots. This test run in the same laboratory with the same iron chips is generally very reproducible.

Those formulas with the lower "% active" can be compared at the higher "% active" by comparing the relative degree of rusting for the 1:10 dilution with the 1:20 dilution respectively.

The results are reported below in Table I.

TABLE I

RUST INHIBITION WITH DICARBOXYLIC ACIDS AND VEGETABLE OIL ADDUCTS

| ACID | % | Moles | TEA % | TEA Moles | DEA % | DEA Moles | % Act. in "formula" | Rust (Dilution ratio of "formula") 1/10 | 1/20 | 1/40 |
|---|---|---|---|---|---|---|---|---|---|---|
| Westvaco Diacid ® | 10 | 1 | | | 6.94 | 1.16 | 16.9 | 3 | 10 | 85 |
| Vegetable Oil Adduct | 10 | 1 | | | 2.83 | 1.16 | 12.8 | | 85 | 100 |
| 90:10 Diacid: Adduct | 10 | 1 | | | 6.5 | 1.16 | 16.5 | | 15 | 90 |
| Diacid | 10 | 1 | 5.31 | 0.63 | 5.97 | 1.0 | 21.9 | 3 | 5 | 35 |
| Adduct | 10 | 1 | 2.00 | 0.63 | 2.25 | 1.0 | 14.9 | 15 | 95 | 100 |
| 90:10 Diacid ®: Adduct | 10 | 1 | 4.98 | 0.63 | 5.69 | 1.0 | 21.3 | 3 | 8 | 90 |
| Adduct | 10 | 1 | 3.80 | 1.16 | | | 15.0 | 50 | 100 | 100 |
| Adduct Na Salt | 10 | 1 | | | | | 10.0 | 100 | 100 | 100 |
| Synkad 500, (Keil) | 8 | 1 | | | 8.8 | 1.38 | 16.8 | 0 | 5 | 40 |

From the above test, it appears that compositions containing Westvaco Diacid ® buffered to 8.3 have a rust inhibiting ability similar to that of a commercial product Synkad 500 by Keil. While the vegetable oil adduct did not appear to have a rust inhibiting effect in itself, it did not noticeably diminish the rust inhibiting effect of the dicarboxylic acid.

EXAMPLE 2

The use of vegetable oil adduct as a defoamer was tested by preparing test solutions containing 0.5% acid (or acid-adduct mixture) and 1% TEA. Waring Blender foam tests were conducted with the test results shown below in Table II.

TABLE II

| TEST SOLUTION | FOAM TESTS WATER | FOAM HEIGHT, CM immed. | 30 sec. | 1 min. |
|---|---|---|---|---|
| Westvaco Diacid ® | tap, 100 ppm hardness | 5 | 2.75 | 2.0 |
| Vegetable Oil Adduct | tap, 100 ppm hardness | 1 | 0.5 | 0.5 |
| 1:1 Diacid: Adduct | tap, 100 ppm hardness | 2.5 | 0.5 | 0.5 |
| 90:10 Diacid: Adduct | distilled, 100 ppm hardness | 10.5 | 10 | 10 |
| Adduct | distilled, 100 ppm hardness | 7.5 | 7.3 | 7.0 |
| 90:10 Diacid: Adduct (magnesium salt form) | distilled, 100 ppm hardness | 10 | 9 | 8.5 |

The tests show that the presence of vegetable oil adduct substantially diminishes the foaming of the dicarboxylic acid solutions.

While the invention has been described and illustrated herein by references to various specific materials, procedures and examples it is understood that the invention is not restricted to the particular materials, combinations of materials and procedures selected for that purpose. Numerous variations of such details can be employed as will be appreciated by those skilled in the art.

What is claimed is:

1. An improved method of inhibiting corrosion of metals exposed to aqueous media comprising contacting said metals with a water-soluble corrosion inhibiting composition comprising a corrosion inhibiting amount of a water-soluble dicarboxylic acid of the formula:

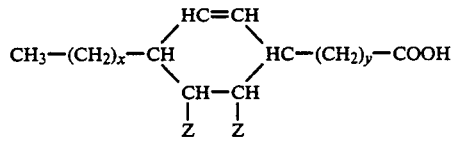

wherein Z is COOH or H, and one of each is present, and x and y are from 3 to 9 with $x+y=12$, wherein the improvement comprises reducing the foaming tendencies of said composition by the addition thereto of (1) a foam inhibiting amount of a vegetable oil adduct of the formula:

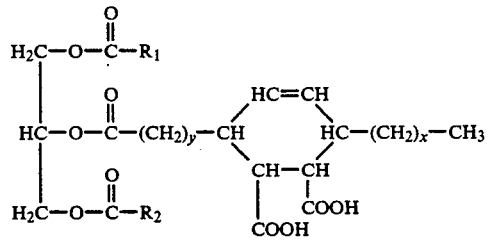

wherein x and y are integers from 3 to 9, x and y together equal 12 and $R_1$ and $R_2$ are saturated or unsaturated hydrocarbon radicals and (2) a base to adjust the pH of the composition to from about 6.5 to about 10.5.

2. The improved method of claim 1 wherein the base is selected from the group consisting of alkali metal and ammonium bases and amine compounds.

3. The improved method of claim 2, wherein the base is an amine compound selected from the group consisting of monoethanolamine, diethanolamine, triethanolamine, ethylene diamine, diethylene triamine, aminoethylethanolamine, tripropylamine, methyl diethanolamine, 2-amino-2-methyl-1-propanol, and mixtures thereof.

4. The composition of claim 1, wherein the vegetable oil adduct is prepared from a vegetable oil selected from the group consisting of soybean oil, cottonseed oil, corn oil, safflower oil, and sunflower oil.

5. The composition of claim 1, wherein the pH is adjusted to from about 8.3 to about 9.5.

6. The composition of claim 1, additionally comprising water.

* * * * *

UNITED STATES PATENT AND TRADEMARK OFFICE
CERTIFICATE OF CORRECTION

PATENT NO. : 5,008,039
DATED : April 16, 1991
INVENTOR(S) : Fred E. Woodward et al.

It is certified that errors appear in the above-identified patent and that said Letters Patent is hereby corrected as shown below:

On the cover page, in the inventor information, before Palm Beach, insert --W--.

In column 2, line 36, delete "2" and substitute therefor --12--.

In column 2, line 46, delete "multi acid" and substitute therefor --multi-acid--.

In column 4, line 27, delete "pKB" and substitute therefor --$pK_B$--.

In column 5, Table II, lines 56 and 57, lines 59 and 60, and lines 62 and 63, delete "100 ppm hardness".

Signed and Sealed this

Second Day of November, 1993

Bruce Lehman

*Attest:*

BRUCE LEHMAN

*Attesting Officer*

*Commissioner of Patents and Trademarks*